US010428762B2

(12) United States Patent
Murakami et al.

(10) Patent No.: US 10,428,762 B2
(45) Date of Patent: Oct. 1, 2019

(54) SURFACE STRUCTURE OF ALUMINUM-BASED MEMBER

(71) Applicant: Suzuki Motor Corporation, Hamamatsu-shi, Shizuoka-ken (JP)

(72) Inventors: Haruhiko Murakami, Hamamatsu (JP); Masahiro Fujita, Hamamatsu (JP); Muneaki Nakamura, Hamamatsu (JP)

(73) Assignee: SUZUKI MOTOR CORPORATION, Hamamatsu-shi, Shizuoka-ken (JP)

( * ) Notice: Subject to any disclaimer, the term of this patent is extended or adjusted under 35 U.S.C. 154(b) by 221 days.

(21) Appl. No.: 15/440,788

(22) Filed: Feb. 23, 2017

(65) Prior Publication Data

US 2017/0254294 A1 Sep. 7, 2017

(30) Foreign Application Priority Data

Mar. 7, 2016 (JP) ..... 2016-043445
Jan. 16, 2017 (JP) ..... 2017-005381

(51) Int. Cl.
*F02F 7/00* (2006.01)
*C25D 11/08* (2006.01)
(Continued)

(52) U.S. Cl.
CPC ..... *F02F 7/0085* (2013.01); *C25D 11/04* (2013.01); *C25D 11/08* (2013.01); *C25D 11/18* (2013.01);
(Continued)

(58) Field of Classification Search
CPC ..... F02F 7/0085; C25D 11/04; C25D 11/246; C25D 11/20
See application file for complete search history.

(56) References Cited

U.S. PATENT DOCUMENTS 9,863,312 B2 * 1/2018 Nishikawa ..... C22C 21/02
2014/0076263 A1 * 3/2014 Sato ..... C25D 11/005 123/193.6
(Continued)

FOREIGN PATENT DOCUMENTS

JP 2015-031226 A 2/2015
JP 2015-193915 A 11/2015
WO WO 2015/019145 A2 2/2015

OTHER PUBLICATIONS

Office Action and English-language translation, DE Application No. 10 2017 104 090.0, dated May 8, 2018, 12 pp.
(Continued)

*Primary Examiner* — Hai Vo
(74) *Attorney, Agent, or Firm* — Myers Bigel, P.A.

(57) ABSTRACT

To provide a surface structure of an aluminum-based member which can further improve heat insulating properties and heat shielding properties of the aluminum-based member. In an aluminum-based member 1 containing at least a silicon composition, a porous oxide film 2 is provided on a surface of the aluminum-based member 1, and the oxide film 2 is constituted to have at least a pore 2*a* extending from the surface toward an inside in a thickness direction of the oxide film 2 and a void 3*a* present inside the silicon composition 3 extending in a direction substantially orthogonal to the thickness direction of the oxide film 2.

11 Claims, 6 Drawing Sheets

(51) Int. Cl.

| | |
|---|---|
| ***C25D 11/18*** | (2006.01) |
| ***F01M 1/02*** | (2006.01) |
| ***C25D 11/04*** | (2006.01) |
| ***C25D 11/20*** | (2006.01) |
| ***C25D 11/24*** | (2006.01) |
| ***F02F 1/00*** | (2006.01) |
| ***F02F 3/00*** | (2006.01) |
| ***C25D 11/10*** | (2006.01) |
| ***C25D 11/16*** | (2006.01) |
| ***F02F 1/18*** | (2006.01) |

(52) U.S. Cl.

CPC ..... *C25D 11/20* (2013.01); *C25D 11/246* (2013.01); *F01M 1/02* (2013.01); *F02F 1/004* (2013.01); *C25D 11/10* (2013.01); *C25D 11/16* (2013.01); *F02F 1/18* (2013.01); *F02F 3/0084* (2013.01); *Y10T 428/24997* (2015.04); *Y10T 428/24999* (2015.04)

(56) References Cited

U.S. PATENT DOCUMENTS

| | | | |
|---|---|---|---|
| 2016/0138179 | A1 | 5/2016 | Murakami et al. |
| 2016/0177818 | A1 | 6/2016 | Nishikawa et al. |

OTHER PUBLICATIONS

Office Action corresponding to Japanese Application No. 2016-043445 dated Sep. 21, 2016.

Decision of Rejection corresponding to Japanese Application No. 2016-043445 dated Nov. 8, 2016.

* cited by examiner

SURFACE STRUCTURE OF ALUMINUM-BASED MEMBER

RELATED APPLICATIONS

This application claims priority from Japanese Patent Application No. 2016-043445, filed Mar. 7, 2016 and from Japanese Patent Application No. 2017-005381, filed Jan. 16, 2017, the disclosures of which are incorporated by reference herein in their entirety.

FIELD OF THE INVENTION

The present invention relates to a surface structure of an aluminum-based member and more specifically to a surface structure of an aluminum-based member including a porous oxide film on a surface of the aluminum-based member.

BACKGROUND OF THE INVENTION

Conventionally, in order to improve heat insulating properties and heat shielding properties of an aluminum-based member used in a vehicle and the like, an anodic oxide film having a pore inside has been formed on a surface of the aluminum-based member.

For example, Japanese Patent Application Laid-Open No. 2015-31226 describes a constitution including an anodic oxide film with low heat conduction and a low volume specific heat capacity on a part of or the whole of a wall surface facing a combustion chamber of an internal combustion engine. According to this Japanese Patent Application Laid-Open No. 2015-31226, this anodic oxide film has its film thickness within a range of 30 to 170 μm and has a first micro pore having a micro-sized diameter and extending from a surface of the anodic oxide film toward an inside in a thickness direction or in a substantially thickness direction, a nano pore having a nano-sized diameter, and a second micro pore located inside the anodic oxide film and having a micro-sized diameter. Moreover, it has a structure in which at least a part of the first micro pore and the nano pore is sealed by a sealing agent, but at least a part of the second micro pore is not sealed.

Moreover, according to Japanese Patent Application Laid-Open No. 2015-31226, an aluminum-based material forming an aluminum-based wall surface contains at least one kind of Si, Cu, Mg, Ni, and Fe as an alloy component.

By having the alloy component contained or particularly by having at least one kind of Si, Cu, Mg, Ni, and Fe contained as the alloy component in the aluminum-based material, it is described that the diameter or a sectional dimension of the micro pore tends to further increase, expansion of a diameter of the micro pore is promoted, and porosity can be improved.

SUMMARY OF INVENTION

However, in order to give further heat insulating properties and heat shielding properties to the aluminum-based material, it is necessary to increase the pores inside the anodic oxide film, but with a technology described in the aforementioned Japanese Patent Application Laid-Open No. 2015-31226, if the pores are increased, the first micro pores and the second micro pores are connected in some cases. Moreover, with an action of a surface tension of the sealing agent, it is difficult to carry out pore scaling treatment so as not to seal only the second micro pores. Moreover, since the second micro pores are present in a lower part of the anodic oxide film in a large quantity, there is a concern that heat is retained on the surface side of the anodic oxide film.

Moreover, in the prior-art anodic oxidation treatment, though there are various electrolytic conditions of a voltage and a current, it is generally carried out by DC electrolysis. In this DC electrolysis, a pore diameter can be controlled by controlling the voltage. As a method for obtaining an effect of the heat insulating properties, a nano-level pore in a columnar structure of aluminum oxide grown by the DC electrolysis has been used, and its volume rate in the film was as low as approximately 20% in the case of a sulfuric acid bath. Thus, pore diameter enlargement treatment has been carried out by changing an electrolytic bath component, an electrolytic condition, a temperature and the like at the anodic oxidation treatment and the like and by immersing it in a drug solution after the anodic oxidation treatment.

In such pore diameter enlargement treatment, oxalic acid or phosphoric acid was used rather than sulfuric acid in order to increase a porosity in the columnar structure. However, use of oxalic acid or phosphoric acid can raise an applied voltage more than sulfuric acid, but since heat generation becomes large during treatment, current density cannot be increased much, and there was a problem of a lowered film forming speed, which was not suitable for film thickening. Moreover, since the pore diameter enlargement treatment is a method of chemically melting aluminum oxide of the columnar structure, a film surface is coarsened, which increases a drug solution treatment process and process control for that and makes manufacture cumbersome.

Therefore, fabrication of an anodic oxidation film with high porosity (here, the nano-sized pores and the micro-sized pores are collectively called pores) by a sulfuric acid bath with a high film-forming speed has been in demand. In order to meet such a demand, in the technology described in Japanese Patent Application Laid-Open No. 2015-31226, by having at least one kind of Si, Cu, Mg, Ni, and Fe contained as an alloy component, the micro pore is expanded so as to ensure high porosity. In this case, Si is contained in many cases particularly with a purpose of increasing intensity of aluminum components in these alloy components. However, this insoluble silicon particle with high heat conductivity has a defect that it conducts heat to the film rapidly while a shape after casting is maintained.

Furthermore, in a case in which the micro pore is expanded only by having at least one kind of Si, Cu, Mg, Ni, and Fe contained as the alloy component, it is difficult to ensure high porosity that gives sufficient heat insulating properties and heat shielding properties.

The present invention was made in view of these circumstances and its object is to provide a surface structure of an aluminum-based member which can reduce retention of heat on the surface side of the oxide film and can further improve heat insulating properties and heat shielding properties of the aluminum-based member.

In order to solve the aforementioned problem, in an aspect of a surfaces structure of an aluminum-based member according to the present invention, in an aluminum-based member containing at least a silicon composition, for example, in which Si is 8.0 wt % or more, and the total of Cu, Ni, Mg, Mn, Zn and Fe is 2.9 wt % or more, and the remaining part consists of aluminum and inevitable impurities, a porous oxide film is provided on a surface of the aluminum-based member, and the oxide film is constituted to have at least a pore extending from the surface toward an inside in a thickness direction of the oxide film and a void present inside the silicon composition extending in a direction substantially orthogonal to the thickness direction of the oxide film. The Cu, Ni, Mg, Mn, Zn and Fe are compositions eluted to a treatment liquid when the oxide film is generated.

In an aspect of a surface structure of an aluminum-based member according to the present invention, it is constituted such that an average length of the void in a thickness direction of the oxide film is larger than an average diameter of the pore.

In an aspect of a surface structure of an aluminum-based member according to the present invention, it is constituted such that a length of the silicon composition contained in the aluminum-based member in the thickness direction of the oxide film is 1 μm or more and 40 μm or less.

In an aspect of a surface structure of an aluminum-based member according to the present invention, it is constituted such that the aluminum-based member contains 8 wt % or more and 30 wt % or less of the silicon composition.

In an aspect of a surface structure of an aluminum-based member according to the present invention, it is constituted such that the aluminum-based member contains a composition eluted to a treatment liquid when the oxide film is generated.

In an aspect of a surface structure of an aluminum-based member according to the present invention, it is constituted such that density of the oxide film is $0.6\times10^3$ kg/m$^3$ or more and $1.1\times10^3$ kg/m$^3$ or less.

In an aspect of a surface structure of an aluminum-based member according to the present invention, it is constituted such that the porosity of the oxide film is 70% or more and 90% or less.

In an aspect of a surface structure of an aluminum-based member according to the present invention, it is constituted such that heat conductivity of the oxide film is 0.65 W/m·K or less.

In an aspect of a surface structure of an aluminum-based member according to the present invention, it is constituted such that the pores are sealed by a sealing product.

In an aspect of a surface structure of an aluminum-based member according to the present invention, a member constituting an internal combustion engine is formed by the aluminum-based member.

In the surface structure of the aluminum-based member according to the present invention, for example, in which Si is 8.0 wt % or more, and the total of Cu, Ni, Mg, Mn, Zn and Fe is 2.9 wt % or more, and the remaining part consists of aluminum and inevitable impurities, since the oxide film on the surface of the aluminum-based member has at least a pore extending from the surface toward the inside in the thickness direction of the oxide film and the void present inside the silicon composition extending in the direction substantially orthogonal to the thickness direction of the oxide film, the pores can be present inside the oxide film in a large quantity. As a result, the heat insulating properties and heat shielding properties of the oxide film can be further improved, and since the void is present inside the silicon composition, the gap can be made difficult to be filled in a pore sealing treatment process. That is because wettability of aluminum oxide which is a metal oxide against the sealing agent is higher than silicon which is metal and the sealing agent can enter easily. Moreover, since the silicon composition is present uniformly in the aluminum-based member, the void can be provided uniformly in the oxide film, and heat retention in the oxide film can be uniformly suppressed over the inside of the film. Furthermore, in a case in which the aluminum-based member contains 8 wt % or more of the silicon composition, the silicon composition can be coarsened, and voids can be formed in large number inside the silicon composition. At the same time, by having 2.9 wt % of the total of the metal compositions of Cu, Ni, Mg, Mn, Zn and Fe contained in the aluminum-based member, since the metal compositions are eluted to a treatment liquid when the oxide film is generated, and the portion forms a void, many voids, effective for heat insulating properties and heat shielding properties can be formed.

In the aspect of a surface structure of an aluminum-based member according to the present invention, since it is constituted such that the average length of the void in the thickness direction of the oxide film is larger than the average diameter of the pore, the heat conducted from the surface of the oxide film can be effectively shielded by the void inside the silicon composition.

In the aspect of a surface structure of an aluminum-based member according to the present invention, since it is constituted such that the length of the silicon composition contained in the aluminum-based member in the thickness direction of the oxide film is 1 μm or more and 40 μm or less, by setting the length in the thickness direction of the oxide film to 40 μm or less, stress per unit area against tensile stress around the silicon composition can be increased. Moreover, by setting the average length of the silicon composition contained in the aluminum-based member in the thickness direction to 1 μm or more, the void can be generated more easily inside the silicon composition when the oxide film is to be formed.

In the aspect of a surface structure of an aluminum-based member according to the present invention, since it is constituted such that the aluminum-based member contains 8 wt % or more and 30 wt % or less of the silicon composition, by setting the wt % of the silicon composition to 8 wt % or more, the silicon composition can be coarsened, and the void can be generated more easily inside the silicon composition when the oxide film is to be formed. Moreover, if the amount of the silicon composition is 30 wt % or less, the aluminum-based member can be worked easily with favorable machinability, which is practical.

In the aspect of a surface structure of an aluminum-based member according to the present invention, since it is constituted such that a composition eluted to a treatment liquid when the oxide film is generated is contained in the aluminum-based member, these compositions are eluted into the treatment liquid when the oxide film is formed, and places where these compositions were present become pores of the oxide film and thus, a porosity in the oxide film can be improved. As the composition eluted into the treatment liquid when the oxide film is to be formed (assuming a case where dilute sulfuric acid is used as the treatment liquid, for example), Cu, Ni, Mg, Mn, Zn, Fe and the like can be cited.

In the aspect of a surface structure of an aluminum-based member according to the present invention, since it is constituted such that density of the oxide film is $0.6\times10^3$ kg/m$^3$ or more and $1.1\times10^3$ kg/m$^3$ or less, if the density of the oxide film is $0.6\times10^3$ kg/m$^3$ or more, film intensity that can bear use can be obtained. Moreover, if the density of the oxide film is $1.1\times10^3$ kg/m$^3$ or less, volume specific heat capacity and heat conductivity can be reduced.

In the aspect of a surface structure of an aluminum-based member according to the present invention, since it is constituted such that porosity of the oxide film is 70% or more and 90% or less, if the porosity of the oxide film is 70% or more, the volume specific heat capacity can be reduced. If the porosity of the oxide film is 90% or less, film intensity that can bear use can be obtained.

In the aspect of a surface structure of an aluminum-based member according to the present invention, since it is constituted such that heat conductivity of the oxide film is 0.65 W/m·K or less, heat insulating properties/heat shielding properties of the oxide film can be improved.

In the aspect of a surface structure of an aluminum-based member according to the present invention, since it is constituted such that the pores are sealed by a sealing product, heat is not easily conducted to an inside of the oxide film from the surface of the aluminum-based member, and heat insulating properties/heat shielding properties of the oxide film can be improved. Moreover, even if a corrosive substance adheres to the surface of the aluminum-based member, the corrosive substance is not easily transmitted to the inside of the oxide film through the pore and thus, durability of the oxide film can be improved.

In the aspect of a surface structure of an aluminum-based member according to the present invention, since a member constituting an internal combustion engine is formed by the aluminum-based member which has achieved low heat conductivity and low volume specific heat capacity as described above, heat efficiency of the internal combustion engine can be improved.

DETAILED DESCRIPTION OF THE PREFERRED EMBODIMENTS

The present invention now will be described more fully hereinafter in which embodiments of the invention are provided with reference to the accompanying drawings.

This invention may, however, be embodied in many different forms and should not be construed as limited to the embodiments set forth herein; rather, these embodiments are provided so that this disclosure will be thorough and complete, and will fully convey the scope of the invention to those skilled in the art.

The terminology used in the description of the invention herein is for the purpose of describing particular embodiments only and is not intended to be limiting of the invention.

As used in the description of the invention and the appended claims, the singular forms "a", "an" and "the" are intended to include the plural forms as well, unless the context clearly indicates otherwise. Unless otherwise defined, all technical and scientific terms used herein have the same meaning as commonly understood by one of ordinary skill in the art to which this invention belongs. All references cited are incorporated herein by reference in their entirety.

Hereinafter, an embodiment of a surface structure of an aluminum-based member according to the present invention will be described.

Figure 1:
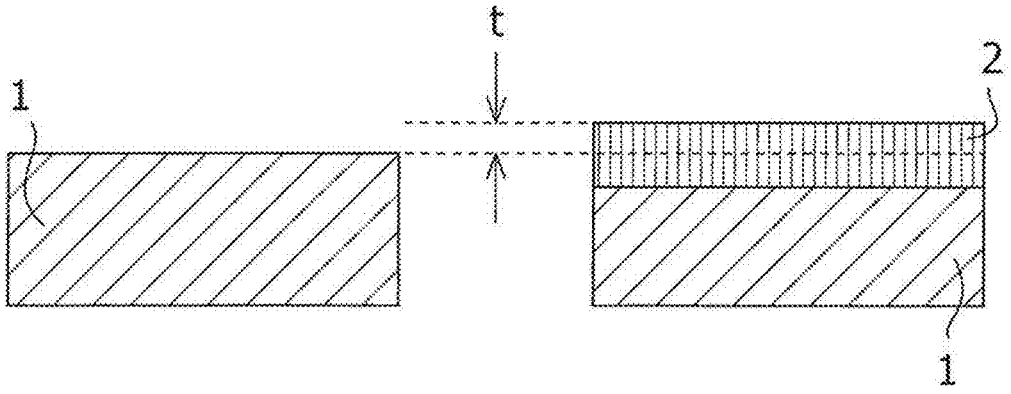
FIG. 1 illustrates an embodiment of a surface structure of an aluminum-based member according to the present invention and is a sectional view illustrating states before and after an oxide film is formed on a surface of the aluminum-based member.
Figure 2A:
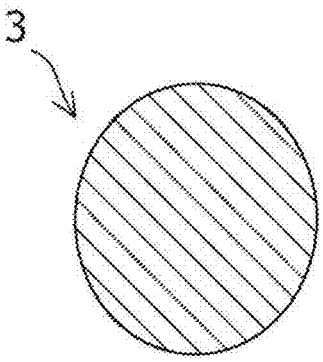
FIGS. 2A and 2B illustrate the embodiments of the surface structure of the aluminum-based member according to the present invention and is a sectional view illustrating states before and after a void is formed in a silicon composition.
Figure 2B:
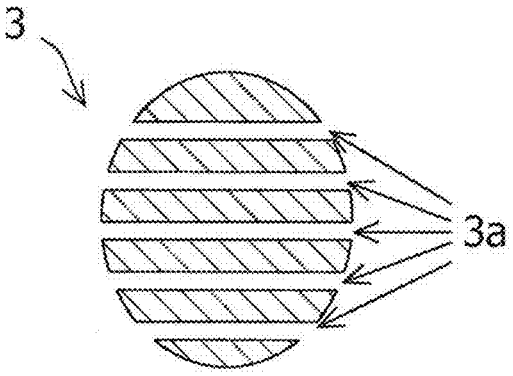
Figure 3:
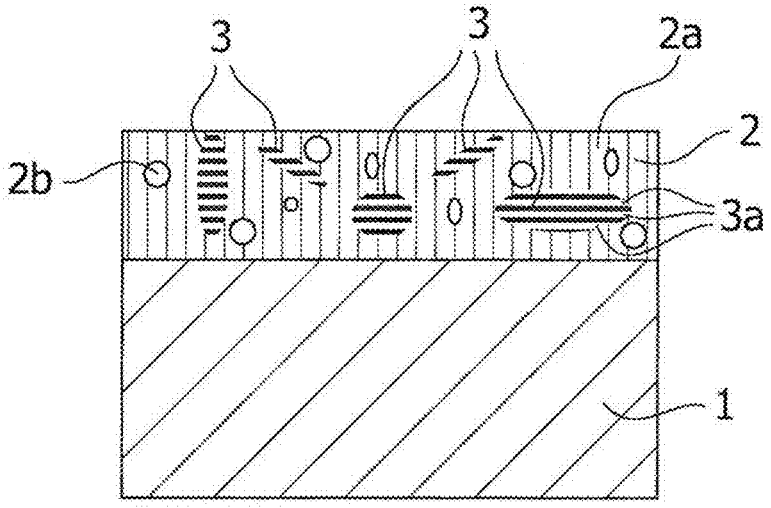
FIG. 3 is a sectional view schematically illustrating the embodiment of the surface structure of the aluminum-based member according to the present invention.

In the surface structure of the aluminum-based member according to this embodiment, as illustrated in FIGS. 1 to 3, in order to improve heat insulating properties of an aluminum alloy base material 1, an anodic oxide film (hereinafter referred to as an oxide film) 2 is provided on a surface of the aluminum alloy base material 1. The aluminum alloy base material 1 is an aluminum-based member containing at least a silicon composition 3, the aluminum-based member, for example, containing at least 8 wt % or more of the silicon composition 3 and 2.9 wt % or more of the total of the metal compositions that are eluted to a treatment liquid, and the silicon composition 3 is insoluble silicon particles, for example.

Moreover, the oxide film 2 has at least a pore 2*a* (see a photo illustrated in FIG. 3) extending in a thickness direction of the oxide film 2 from its surface to an inside, a void 3*a* (see a photo illustrated in FIG. 3) present inside the silicon composition 3 extending in a direction substantially orthogonal to the thickness direction of the oxide film 2, and a void 2*b* (see FIG. 3) directly present in the oxide film 2. Since the shape of the void is simply shown, the shape of the void is different depending on a composition and is not uniform.

Here, a mechanism in which the void 3*a* is formed inside the silicon composition 3 will be described in brief. When the aluminum alloy base material 1 is subjected to anodic oxidation, a volume of the oxide film 2 is expanded as illustrated in FIG. 1. In FIG. 1, reference character t indicates a thickness portion increased by volume expansion of the aluminum alloy base material 1. At this time, the silicon composition 3 contained in the oxide film 2 not subjected to anodic oxidation is scarcely expanded in volume and thus, the silicon composition 3 is pulled to growth of the oxide film 2. As a result, a crack occurs in the direction substantially orthogonal to a growth direction (thickness direction) of the oxide film 2 of the silicon composition 3. By means of this crack, a plurality of the voids 3*a* extending in the direction substantially orthogonal to the thickness direction of the oxide film 2 is formed inside the silicon composition 3. Regarding a shape of the silicon composition 3 that can be cracked easily, if a specific surface area is larger such as an oval or a needle shape, it can be easily cracked than a normal spherical shape.

In this embodiment, by making a crack in the direction perpendicular to the direction to which the heat is transmitted inside the silicon composition 3 of the oxide film 2 as described above, the voids 3*a* influencing the density of the oxide film 2 increase.

Thus, heat conduction is shielded by the void 3*a* in the silicon composition 3 and as a result, the heat conducted to the aluminum alloy base material 1 from the surface of the oxide film 2 is effectively shielded. As a result, the aluminum alloy base material 1 has high heat insulating properties/heat shielding properties, and the prior-art defect that heat is rapidly conducted to the inside in the silicon composition 3 with high heat conductivity can be solved. FIG. 2A illustrates the silicon composition 3 before the crack is made, and FIG. 2B illustrates the silicon composition 3 after the cracks are made.

Moreover, in this embodiment, an average length of the void 3*a* in the thickness direction of oxide film 2 is larger than a diameter of the pore 2*a*. As a result, the heat conducted to a bottom surface from the surface of the oxide film 2 can be effectively shielded by the void 3*a* inside the silicon composition 3. Moreover, since the silicon composition 3 in the aluminum alloy base material 1 is uniformly present in the aluminum alloy base material 1, the voids 3*a* present with the silicon composition 3 are also present uniformly in the oxide film 2. As a result, the heat conducted from the surface of the oxide film 2 to the base material surface is not conducted easily, and a possibility that the heat is retained in the oxide film 2 can be reduced.

Here, the aluminum-based member which is the aluminum alloy base material 1 employed in this embodiment will be described.

The "aluminum-based member" means an aluminum alloy such as an aluminum alloy containing alloy components such as silicon, copper and the like or an aluminum alloy such as an aluminum expansile material, an aluminum cast material, an aluminum die-cast material (ADC) and the like containing them in addition to so-called aluminum. More specifically, an aluminum alloy such as an AC material such as AC4, AC8, AC8A, AC9 and the like, an ADC material such as ADC 10 to ADC 14 and the like, A4000 and the like is appropriate. The details of the composition of the aluminum alloy will be described later.

Subsequently, the oxide film 2 in this embodiment will be described in detail.

The oxide film 2 is formed porously. In the oxide film 2, in addition to the pores 2*a*, there are regular nano-level voids 2*b* generated in the growth process in accordance with the electrolytic condition and the micro-level pores particularly in the aluminum alloy. Since the oxide film 2 obtained by the anodic oxidation treatment grows by oxidizing the aluminum alloy base material 1 itself, close contact is higher than a method of coating the surface of the aluminum alloy base material 1 with a material different from the aluminum alloy base material 1. Thus, the method of forming the oxide film 2 porously according to this embodiment is suitable for formation of a film having heat insulating properties/heat shielding properties.

In this embodiment, as will be described later, if a soluble metal (Cu, Ni, Mg, Mn, Zn, Fe and the like) eluted into the treatment liquid when the oxide film 2 is to be formed on the aluminum alloy base material 1 is contained, DC electrolysis may be carried out by using a sulfuric acid bath. The reason is that a film forming speed is relatively faster in the sulfuric acid bath, which is preferable in improvement of porosity in the silicon particles (portions surrounded by broken-line circles in a photo in FIG. 5). In this case, oxalic acid or phosphoric acid may be used instead of the sulfuric acid, or a drug solution such as oxalic acid, phosphoric acid, hydrofluoric acid, hydrogen peroxide or the like may be added to the sulfuric acid. Improvement of solubility or an increase in a voltage during electrolysis can increase a frequency of cracking in silicon. By dissolving the aforementioned soluble metal in the periphery of the silicon composition 3, the portion makes the void 2*b*, and the oxide film 2 having a much higher porosity, that is, having low density can be formed. The current density is preferably 4.8 $A/dm^2$ or less as the other conditions for DC electrolysis, since the oxide film having lower density can be obtained.

Here, physical characteristics of the oxide film 2 in this embodiment will be described in brief summary.

First, the porosity of the oxide film 2 will be described. The "porosity" in the present invention means a porosity of the total of the pore 2*a* extending in a film direction from the film surface to an inside, the void 3*a* in the silicon composition and the void 2*b* derived from the soluble metal component.

The porosity of the oxide film 2 is 70% or more or more preferably 75% or more. As a result, the volume specific heat capacity can be reduced. Moreover, the porosity of the oxide film 2 is 90% or preferably 85% or less. As a result, the film intensity that can bear use can be obtained. The porosity of the oxide film 2 is calculated on the basis of bulk density and real density of the oxide film 2. If the porosity of the oxide film 2 is 70% or more, the volume specific heat capacity can be reduced, and moreover, if it is 90% or less, the film intensity that can bear use can be obtained.

Subsequently, density of the oxide film 2 will be described.

The density of the oxide film 2 is $0.6\times10^3$ $kg/m^3$ or more or preferably $0.7\times10^3$ $kg/m^3$ or more. As a result, the film intensity that can bear use can be obtained. Moreover, the density of the oxide film 2 is $1.1\times10^3$ $kg/m^3$ or less, preferably $1.0\times10^3$ $kg/m^3$ or less, or more preferably $0.9\times10^3$ $kg/m^3$ or less. If the density of the oxide film 2 is $0.6\times10^3$ $kg/m^3$ or more, the film intensity that can bear use can be obtained and moreover, if the density of the oxide film 2 is $1.1\times10^3$ $kg/m^3$ or less, the volume specific heat capacity and heat conductivity can be reduced. The density ρ of the oxide film 2 was calculated by measurement values obtained by measuring a mass of a test piece cut into a size of 10 mm×10 mm for density measurement and a length of each side by using a micrometer and by measuring a film thickness by observing a section of the test piece by an optical microscope.

Subsequently, the heat conductivity of the oxide film 2 will be described.

The heat conductivity of the oxide film 2 is 0.65 W/m·K or less or preferably 0.60 W/m·K or less. As a result, the volume specific heat capacity can be reduced. The heat conductivity of the oxide film 2 was calculated by a DSC method by using specific heat Cs by using a differential scanning calorimeter (DSC-60Plus by SHIMADZU). And it can be calculated by using an equation (1) on the basis of the specific heat Cs.

Subsequently, the volume specific heat capacity of the oxide film 2 will be described.

The volume specific heat capacity of the oxide film 2 is $1.00\times10^3$ $kJ/m^3\cdot K$ or less, preferably $0.90\times10^3$ $kJ/m^3\cdot K$ or less, or more preferably $0.80\times10^3$ $kJ/m^3\cdot K$ or less. As a result, it has an effect that can reduce the volume specific heat capacity. The volume specific heat capacity is a value obtained by multiplying a product of the density by the specific heat of a substance.

Subsequently, a thickness of the oxide film 2 will be described.

The thickness of the oxide film 2 is preferably 50 μm or more. Moreover, the thickness of the oxide film 2 is 150 μm or less or preferably 120 μm or less. That is, a film thickness of the oxide film 2 is preferably 50 to 120 μm or more preferably within a range from 50 to 100 μm. As a result, the appropriate heat shielding properties/heat insulating properties can be given to the aluminum alloy base material 1.

If the oxide film 2 becomes thick, time for growing the oxide film 2 takes long for that portion and thus, in the case of the oxide film 2 with lower heat conductivity and lower volume specific heat capacity, the thinner oxide film 2 is more effective. A component to be treated is preferably subjected to pre-treatment such as water washing, degreasing, electrolytic etching and the like of an anodic oxidation treatment surface before the anodic oxidation treatment, which is taken out of a treatment liquid after the treatment and is washed by water and dried. The actual film thickness of the oxide film 2 is preferably controlled mainly by time or current density so as to have a film thickness which satisfies predetermined performances.

Moreover, in order to obtain heat insulating properties and heat shielding properties higher than those of the oxide film 2, lower heat conductivity and lower volume specific heat capacity are needed. The heat conductivity $\lambda$ is calculated from the density $\rho$, the specific heat Cs, and thermal diffusivity $\alpha$ in accordance with the following equation (1). The volume specific heat capacity is a product of the density and the specific heat. Since the specific heat is a value specific to a substance, in order to lower the heat conductivity and the volume specific heat capacity, it is necessary to lower the density to be multiplied by the both.

$$\lambda=\alpha\times Cs\times\rho \quad (1)$$

If pure aluminum is subjected to anodic oxidation, the heat conductivity becomes 2.6 [W/m·K] and the volume specific heat capacity becomes 2.5 [$\times10^3$ kJ/m$^3$·K] which are both extremely large. Thus, by enlarging the nano-level pore by changing the electrolytic treatment condition, both can be lowered to some degree for the heat conductivity to 1.2 [W/m·K] and the volume specific heat capacity to 2.0 [$\times10^3$ kJ/m$^3$·K].

However, it is extremely important to lower the volume specific heat capacity which is a main factor for that the heat can be easily retained in the oxide film 2.

Here, the silicon composition 3 according to this embodiment will be described in brief.

First, the length of the silicon composition 3 in the thickness direction of the oxide film 2 will be described.

The average length of the silicon composition 3 in the thickness direction of the oxide film 2 is 1 μm or more, preferably 3 μm or more or more preferably, 5 μm or more. Moreover, the average length of the silicon composition 3 in the thickness direction of the oxide film 2 is 40 μm or less, preferably 30 μm or less or more preferably, 20 μm or less.

As described above, if the average length in the thickness direction of the silicon composition 3 contained in the aluminum-based member is 1 μm or more, stress per unit area against the tensile stress in the periphery becomes large, and when the oxide film 2 is formed, the voids 3*a* are generated easily inside the silicon composition 3. Moreover, if the average length of the silicon composition 3 in the thickness direction is 40 μm or less, the stress per unit area against the tensile stress in the periphery becomes large, and when the oxide film 2 is formed, a crack is generated, and the voids are generated easily inside the silicon composition 3.

Subsequently, an amount of the silicon composition will be described.

The amount of the silicon composition 3 is 8 wt % or more, preferably 10 wt % or more or more preferably, 11 wt % or more. As a result, the silicon composition 3 is coarsened, and when the oxide film 2 is formed, the void 3*a* is generated easily inside the silicon composition 3. Moreover, the amount of silicon composition 3 is 30 wt % or less, preferably 25 wt % or less or more preferably, 20 wt % or less. If the amount of the silicon composition 3 is 30 wt % or less, an aluminum alloy base material 1 which can be worked easily with favorable machinability and the like is obtained, which is practical.

Subsequently, a size and a shape of the silicon composition 3 will be described.

The silicon composition 3 is preferably present uniformly in the oxide film 2. The shape of the silicon composition 3 may be spherical, oval, rectangular, a needle shape and the like. Among them, the larger a specific surface area of the silicon composition 3 becomes, the easier the silicon composition 3 can be cracked when the oxide film 2 is formed, and spots where the voids 3*a* are generated increase. Thus, the shape of the silicon composition 3 is preferably an elliptic shape or a needle shape. However, a crack is generated in the direction substantially orthogonal to the film thickness direction of the oxide film, but large particles extending in the perpendicular direction have small stress per unit area, and an advancing direction of the crack can be shifted from one direction in some cases, but generation of the cracks, that is, a suppression effect of heat conduction by the voids is exerted.

Generation of a crack in the silicon composition 3 is considered to occur if a stress per unit area where the crack is generated is at a certain level or more, but the size/shape of the silicon composition 3 is different depending on a silicon content, a heat treatment conditions and components of the aluminum alloy base material 1 and is not uniform. From a viewpoint of ease of generation of a crack, the higher an aspect ratio of the silicon particles, the higher the stress per unit area of the crack becomes, which is advantageous, but if this aspect ratio becomes high, a path through which the heat is conducted becomes long, and the meaning of generating a crack is reduced.

Thus, a preferable size of the silicon composition 3 is as follows.

It is known that a crack in the silicon composition 3 occurs at an interval of submicron or more, and since the crack is not generated easily in the thickness less than 1 μm of the silicon composition 3 in the perpendicular direction, this thickness in the perpendicular direction is preferably 1 μm or more. Moreover, if this thickness in the perpendicular direction exceeds 40 μm, a crack generation area with respect to the tensile stress from the periphery becomes larger (the stress per unit area decreases), and the crack is not generated easily. Thus, this thickness in the perpendicular direction is preferably 40 μm or less.

Subsequently, a content of silicon will be described.

In the aluminum alloy base material 1, crystal grains of eutectic Si and a primary crystal Si are scattered mainly depending on the silicon content, and as a result, it has features such as high abrasion resistance/slidability/high-temperature intensity.

Thus, this type of aluminum alloy base material 1 is used as materials for engine components such as a piston and a cylinder head and for mechanism components sliding at a high temperature such as an oil pump. The silicon content of the aluminum alloy base material 1 is preferably 8.0 wt % or more which is a practical value so that its feature can be utilized. That is because, if the silicon content is less than 8.0 wt %, not only that practically high abrasion resistance/slidability/high-temperature intensity cannot be exerted but if the silicon content is small, it results in fine eutectic silicon, which makes generation of a crack in the silicon particle difficult, and the heat-shielding effect cannot be expected.

If the silicon amount is large, the number of cracks is high, but a ratio of the silicon with high heat conductivity to the entire oxide film 2 increases, and the heat conductivity rises in the oxide film 2 as a whole.

Moreover, since a driving force of generating a crack in the silicon is derived from volume expansion of the oxide film 2, if the silicon amount is large, a volume expansion rate of the oxide film 2 lowers to the contrary, and cracks are not generated easily. Thus, the silicon content is preferably 25 wt % or less.

Since silicon lowers machinability, this level is preferable also in terms of a practical aspect. More preferably, the silicon content is up to approximately 20 wt % for general use. In summary, particularly an Si content is preferably 8 wt % or more and 25 wt % or less or more preferably, 8 wt % or more and 20 wt % or less. Regarding a size of Si, the thickness in the perpendicular direction is preferably 1 μm or more and 40 μm or less.

By having the aforementioned film structure, the heat conductivity of the oxide film 2 can be set to 0.65 [W/mK] or less, the volume specific heat capacity to 1.00 [$\times 10^3$ kJ/m$^3$K] or less, and the density to 1.10 [$\times 10^3$ kg/m$^3$] or less. As a result, high heat insulating properties/heat shielding properties can be given to a metal component requiring high heat insulating properties/heat shielding properties. Moreover, by providing the oxide film 2 having the heat conductivity of the oxide film 2 set to 0.60 [W/mK] or less, the volume specific heat capacity to 0.90 [$\times 10^3$ kJ/m$^3$K] or less, and the density of the anodic oxide film to 1.00 [$\times 10^3$ kg/m$^3$] or less, the heat insulating properties and the heat shielding properties of the oxide film 2 are further improved, and the high heat insulating/heat shielding effect can be exerted. Furthermore, it is more preferable that the heat conductivity of the oxide film 2 be 0.60 [W/mK] or less, the volume specific heat capacity be 0.80 [$\times 10^1$ kJ/m$^3$K] or less, and the density of the anodic oxide film be 0.90 [$\times 10^3$ kg/m$^3$] or less.

In this embodiment, in order to improve the porosity of the oxide film 2, a composition other than the silicon composition 3 may be contained in the aluminum-based member 1. As the composition other than silicon, a composition eluted when the oxide film 2 is to be formed, that is, Cu, Ni, Mg, Mn, Zn, or Fe, for example, and one kind or plural kinds of them may be contained. If these compositions are contained at 2.9 wt % or more in total, they are eluted when the oxide film 2 is to be formed, and places where these compositions were present become voids **2*b*** in the oxide film and thus, porosity in the oxide film can be improved. The total of Cu, Ni, Mg, Mn, Zn, and Fe is preferably 3.0 wt % or more, or is more preferably 4.0 wt % or more. Although the upper limit of the total of these compositions is not specifically limited, the total is preferably 20.0 wt % or less, or more preferably 11.0 wt % or less. Besides these compositions, compositions of Ti, Zr, Sn, Cr, Pb and the like may be contained as inevitable impurities that are not soluble when the oxide film is formed. The remaining part is Al.

Figure 6:
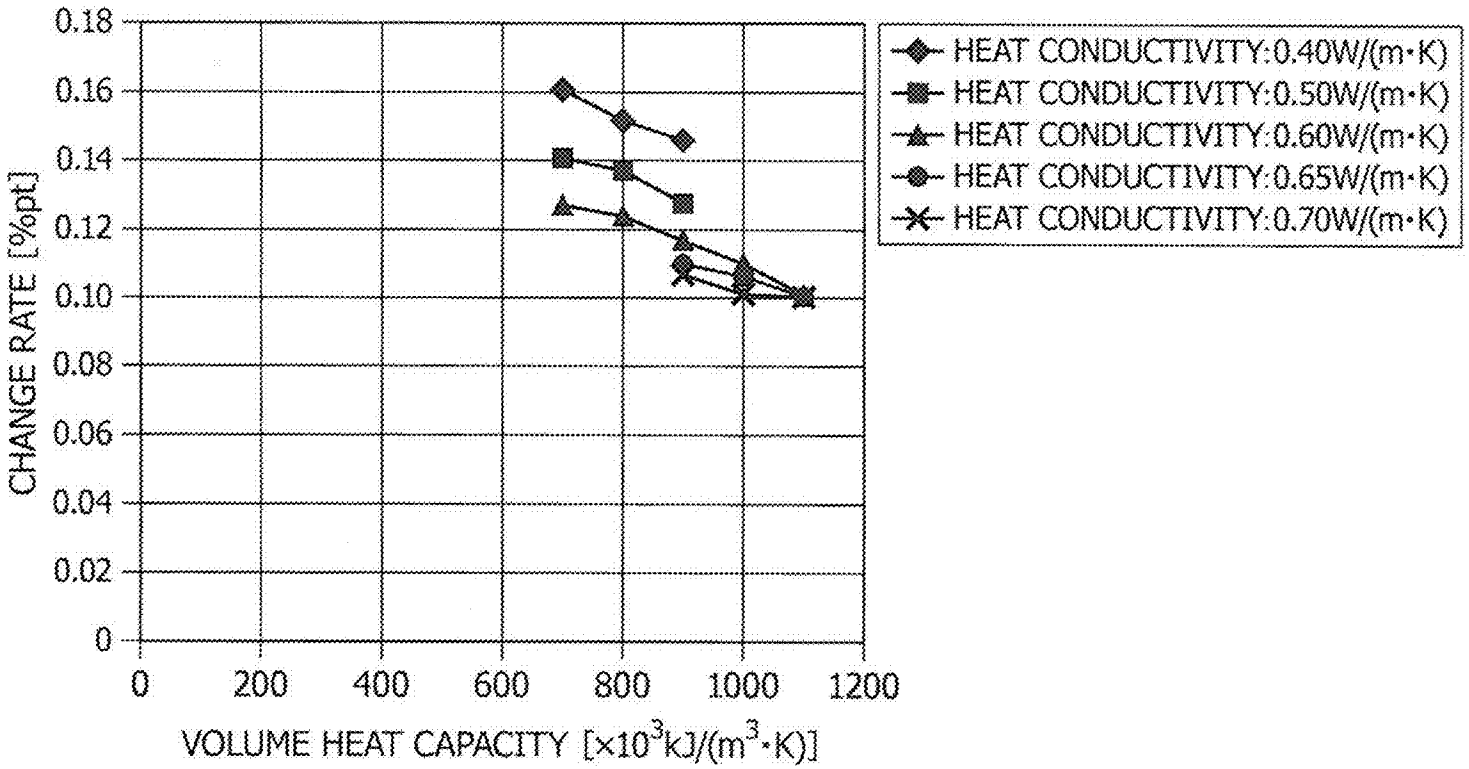
FIG. 6 is a graph illustrating heat efficiency in an internal combustion engine to which the embodiment of the surface structure of the aluminum-based member according to the present invention is applied.

In this embodiment, by means of one-dimensional engine performance calculation, illustrated heat efficiency with respect to the heat conductivity and the volume specific heat capacity was analyzed (see a graph in FIG. 6).

As a result of the analysis, particularly assuming that the heat conductivity is 0.65 [W/m·K] or less and the volume specific heat capacity is 1.00 [$\times 10^3$ kJ/m$^3$·K] or less, a change rate exceeds 0.1% pt, and it is known that the effect can be exerted more easily. With the change rate of 0.1% pt or less, an improvement margin can be cancelled easily by the other factors on an actual machine basis and does not appear easily as a numerical value, and thus, 0.1% pt or more was set as a reference. With the heat conductivity of 0.70 [W/m·K], the change rate was 0.1% pt for both the volume specific heat capacities of 1.00 [$\times 10^3$ kJ/m$^3$·K] and 1.10 [$\times 10^3$ kJ/m$^3$·K], and the reduction effect of the volume specific heat capacity was not exerted. In particular, as can be understood from the result of FIG. 6, in all cases in which the volume specific heat capacities is 0.80 [$\times 10^3$ kJ/m$^3$·K] or less, it is presumed that each heat conductivity is 0.65 [W/m·K] or less, and thus, regarding the heat efficiency, the change rate of approximately 0.12% pt in which the improvement margin is difficult to be cancelled on an actual machine basis can be obtained.

From the aforementioned result, it is preferable that the heat conductivity is 0.65 [W/m·K] or less and the volume specific heat capacity is 1.00 [$\times 10^3$ kJ/m$^3$·K] or less, it is more preferable that the heat conductivity is approximately 0.60 [W/m·K] or less and the volume specific heat capacity is 0.90 [$\times 10^3$ kJ/m$^3$·K] or less at which the reduction effect of the volume specific heat capacity can be further exerted, or it is furthermore preferable that the volume specific heat capacity be 0.80 [$\times 10^3$ kJ/m$^3$·K] or less, and the effect as described above can be favorably exerted in this case.

The specific heat of the oxide film 2 is slightly varied depending on a kind of the alloy but it turned out to be approximately 0.83 [$\times 10^3$ kJ/kgK]. Thus, in order to have the volume specific heat capacity at 1.00 [$\times 10^3$ kJ/m$^3$K] or less, the density of the oxide film 2 needs to be 1.1 [$\times 10^3$ kg/m$^3$] or less. More preferably, in order to have the volume specific heat capacity at 0.90 [$\times 10^3$ kJ/m$^3$K] or less, the density of the oxide film 2 needs to be 1.00[$\times 10^3$ kg/m$^3$] or less. Furthermore preferably, in order to have the volume specific heat capacity at 0.80 [$\times 10^3$ kJ/m$^3$K] or less, the density of the oxide film 2 needs to be 0.90 [$\times 10^1$ kg/m$^3$] or less. The density of aluminum oxide containing an alloy component can be approximately 5 [$\times 10^3$ kg/m$^3$], and in this case, its porosity is 82%.

A porosity of the oxide film 2 fabricated by a sulfuric acid bath is approximately 20% in general. It is varied if an alloy component is contained, but in order to have such low density in the oxide film 2, new technical development is expected. By lowering the density of the oxide film 2, the heat conductivity can be similarly reduced as is obvious from the aforementioned equation (1), but in this idea, by generating the crack (void) **3*a* in the silicon composition 3 and by forming the void 2*b* derived from a soluble metal that is directly present in the oxide film 2**, thermal diffusivity is to be reduced and the density is also to be reduced.

The aluminum alloy component is constituted by aluminum and impurities contained therein or an additive in general. The aluminum alloy includes an aluminum die-cast material, an aluminum cast material, an aluminum expansile material and the like, for example. There are many impurities or additives in the aluminum alloy component, but in order to have the density of the oxide film 2 at 1.10[$\times 10^3$ kg/m$^3$] or less, concentration of a metal component other than aluminum needs to be adjusted and is subjected to anodic oxidation via the method as in this embodiment.

Subsequently, a test example in which a metal component in the aluminum alloy used for the electrolytic treatment of the sulfuric acid bath was measured will be described.

The following Table 1 indicates the metal component other than aluminum in the aluminum alloy used for the electrolytic treatment of the sulfuric acid bath. The anodic oxidation treatment was carried out by the DC electrolytic method at constant current density so as to form a test piece of the oxide film 2 of 35×15×2 mm. The anodic oxidation treatment was conducted at 15° C. and with sulfuric acid concentration of 300 g/L, 4.8 A/dm$^2$ for 40 minutes. The film thickness of the film was different depending on the alloy component and was 68.7 to 92.4 μm.

TABLE 1

| Metal component of used test piece | | | | | | | | | | | | | |
|---|---|---|---|---|---|---|---|---|---|---|---|---|---|
| | Cu* | Si | Mg* | Zn* | Fe* | Mn* | Ni* | Ti | Sn | Cr | Pb | Zr | Total of Soluble Metal Components |
| Example 1 | 1.19 | 11.01 | 0.87 | 0.02 | 0.33 | 0.09 | 1.05 | 0.02 | 0.02 | 0.00 | 0.01 | 0.01 | 3.55 |
| Example 2 | 2.78 | 8.80 | 0.23 | 0.27 | 0.33 | 0.23 | 0.03 | 0.02 | 0.02 | 0.02 | 0.01 | 0.00 | 3.87 |
| Example 3 | 0.91 | 11.43 | 1.05 | 0.01 | 0.14 | 0.00 | 0.91 | 0.02 | 0.02 | 0.00 | 0.00 | 0.00 | 3.02 |
| Example 4 | 3.27 | 12.18 | 0.67 | 0.02 | 0.44 | 0.06 | 2.17 | 0.01 | 0.02 | 0.01 | 0.01 | 0.08 | 6.63 |
| Example 5 | 3.23 | 11.50 | 0.81 | 0.02 | 0.32 | 0.03 | 1.91 | 0.07 | 0.02 | 0.01 | 0.00 | 0.06 | 6.32 |
| Comparative Example 1 | 1.75 | 7.80 | 0.23 | 0.27 | 0.33 | 0.23 | 0.03 | 0.02 | 0.02 | 0.02 | 0.01 | 0.00 | 2.84 |
| Comparative Example 2 | 0.16 | 0.13 | 0.12 | 0.01 | 0.63 | 0.00 | 0.02 | 0.02 | 0.06 | 0.00 | 0.00 | 0.00 | 0.94 |

*is a soluble metal component.

A mass and a length of each side by using a micrometer of the test piece cut into 10×10 mm for density measurement were measured, and the film thickness was measured by observing a section of the test piece by an optical microscope. The density ρ of the film was calculated from these measurement values.

Figure 7:
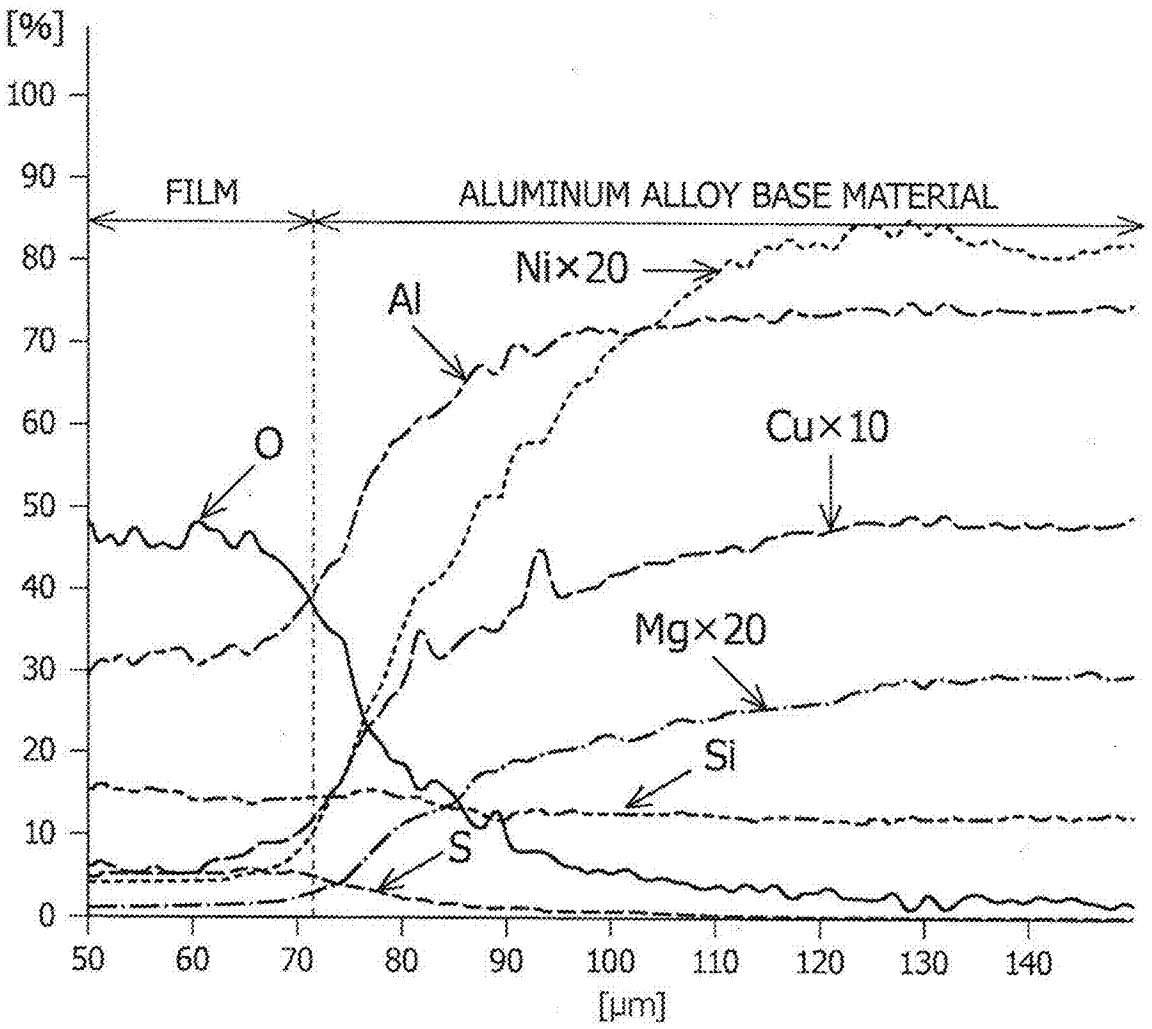
FIG. 7 is a graph illustrating an example of a result of component analysis of the embodiment of the surface structure of the aluminum-based member according to the present invention.

The specific heat Cs was calculated by the DSC method by using a differential scanning calorimeter. The equation (1) was used for calculation of the heat conductivity λ, and the heat diffusivity α was measured by a laser flash method. Component analysis of an inside of the base material was conducted from the surface of the film by using a glow-discharge emission spectral analysis device GDS. An example of the result is shown in a graph in FIG. 7. The metal components Cu, Ni, Mg, Mn, Zn, Fe and the like are soluble metal components, while Si and other metals are insoluble metal components. The density of the alloy component in Examples 1 to 4 or particularly of the film fabricated on the aluminum alloy surface with the Si content of 8 wt % or more and the soluble metal composition content of 2.9 wt % or more was 1.10[×10$^3$ kg/m$^3$] or less. That is because, when a soluble metal is used, the portion makes a pore, a crack is generated in the Si particle which is an insoluble metal, and a pore caused by growth inhibition and volume expansion of the film is generated in its periphery.

Particularly, assuming that the thickness in the perpendicular direction of the insoluble Si particle is 1 μm or more and 40 μm or less, a structure in which the metal lowering the heat conductivity of the oxide film 2 is split horizontally (a direction perpendicular to the heat conducting direction from the surface to the inside of the film) is obtained, whereby the heat conductivity of the oxide film 2 is reduced.

Figure 4:
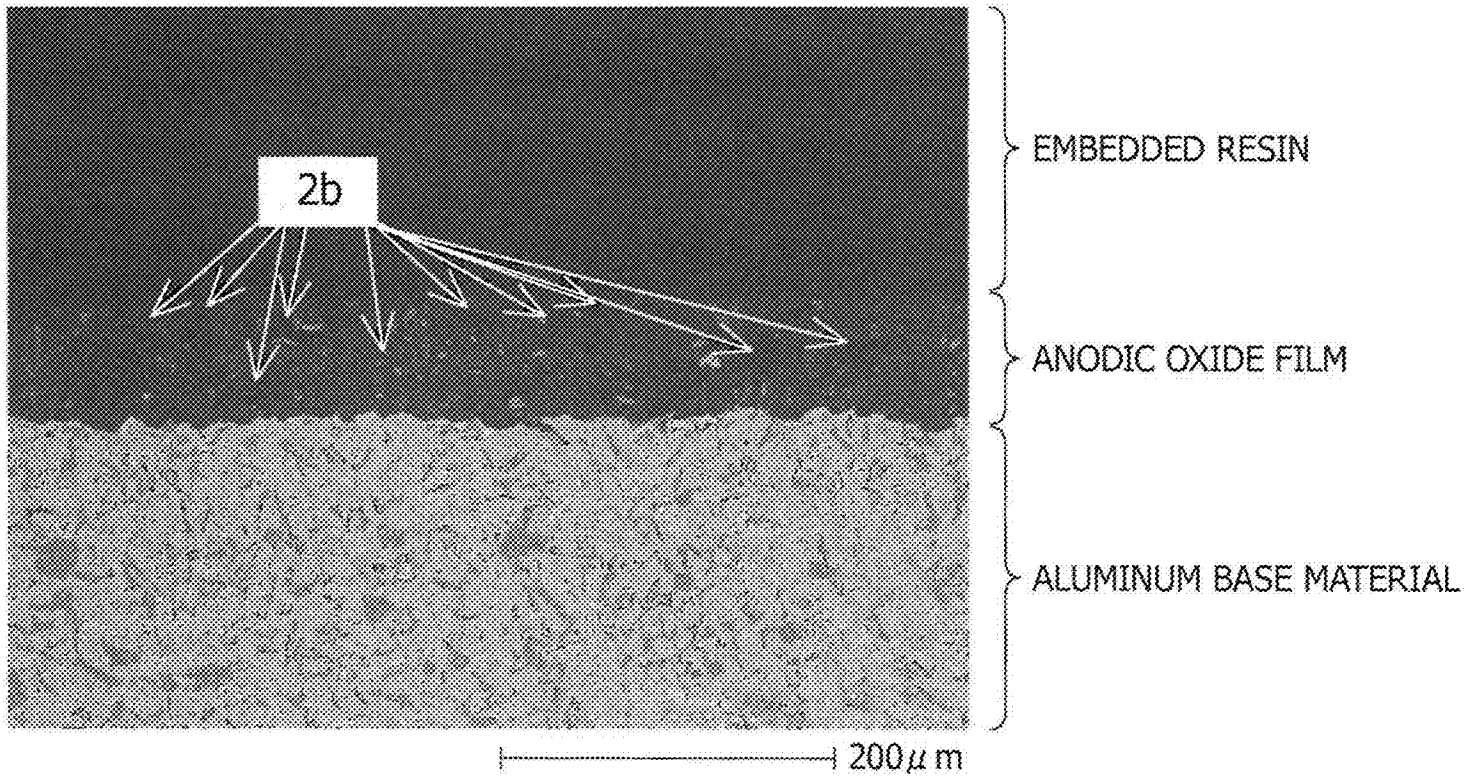
FIG. 4 illustrates a film sectional photo of the embodiment of the surface structure of the aluminum-based member according to the present invention.
Figure 5:
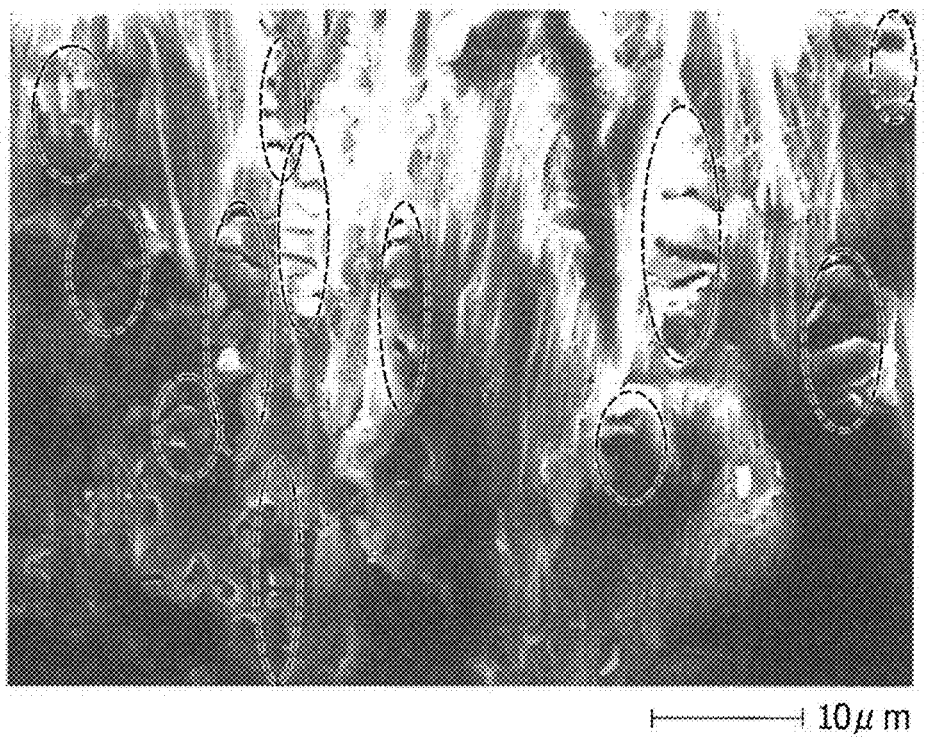
FIG. 5 illustrates the film sectional photo of the embodiment of the surface structure of the aluminum-based member according to the present invention.

FIGS. 4 and 5 illustrate the section in photo of the oxide film 2 fabricated in Example 4 in Table 1. Here, FIG. 4 is an optical microscopic photo, and FIG. 5 is a SEM photo. In these photos of the section, the film section was observed by embedding the test piece with a resin and by polishing its surface. It is known from the photo of the section that the voids 3*a* that are formed in the Si particle are formed in a large quantity, the Si particle being a metal that inhibits growth of the void 2*b* and the oxide film 2 by metal dissolution. However, not all the voids are marked.

Moreover, as illustrated in FIG. 5, it is confirmed that the inside of the insoluble silicon composition 3 is fractured in the horizontal direction, and the voids 3*a* are present between them. However, not all the voids are marked. This fine structure inhibits the heat conduction in the silicon composition 3 and as a result, the heat conductivity is reduced. In Comparative Examples 1 and 2 indicated in the following table 2, mainly since the Si content is small and the content of the total of the soluble metals is small, the density could not be made 1.10[×10$^3$ kg/m$^3$] or less.

TABLE 2

| Test result | | | | |
|---|---|---|---|---|
| | Specific heat capacity [kJ/(kg · K)] | Density [×10$^3$ kg/m$^3$] | Volume specific heat capacity [×10$^3$ kJ/m$^3$ · K] | Heat conductivity [W/m · K] |
| Example 1 | 0.845 | 0.962 | 0.812 | 0.43 |
| Example 2 | 0.886 | 1.100 | 0.975 | 0.65 |
| Example 3 | 0.858 | 0.981 | 0.840 | 0.57 |
| Example 4 | 0.845 | 0.961 | 0.811 | 0.58 |
| Example 5 | 0.845 | 0.980 | 0.828 | 0.60 |
| Comparative Example 1 | 0.843 | 1.213 | 1.022 | 0.68 |
| Comparative Example 2 | 0.828 | 2.440 | 2.020 | 1.20 |

Furthermore, the result of the anodic oxidation treatment, in which the current density and the sulfuric acid concentration are changed, is shown in Table 3, the treatment using a test piece consisting of the same metal compositions of the test piece of Example 1 in which the anodic oxidation treatment was carried out under the conditions in which the sulfuric acid concentration is 300 g/L and the current density is 4.8 A/dm$^2$. As shown in FIG. 3, when the current density is 4.8 A/dm$^2$, the film density is 1.10[×10$^3$ kg/m$^3$] or less. However, when the current density exceeds 4.8 A/dm$^2$, the film density cannot be 1.10[×10$^3$ kg/m$^3$] or less even though the sulfuric acid concentration is changed.

TABLE 3

| Results of changing the current density and sulfuric acid concentration | | |
|---|---|---|
| Current Density [A/dm$^2$] | Concentration [g/L] | Film Density [×10$^3$ kg/m$^3$] |
| 4.8 | 50 | 1.00 |
| | 200 | 0.97 |
| | 300 | 0.91 |

TABLE 3-continued

| Results of changing the current density and sulfuric acid concentration | | |
|---|---|---|
| Current Density [A/dm$^2$] | Concentration [g/L] | Film Density [×10$^3$ kg/m$^3$] |
| 8.0 | 15 | 1.47 |
| | 25 | 1.54 |
| | 100 | 1.11 |
| | 200 | 1.19 |
| 1.6 | 15 | 1.35 |
| | 25 | 1.55 |
| | 50 | 1.39 |
| | 100 | 1.32 |
| | 200 | 1.49 |
| | 300 | 1.27 |

Subsequently, regarding the anodic oxide film having desired low heat conductivity and low volume specific heat capacity of the present invention, another embodiment will be described. In a case in which it is difficult to achieve the purpose to obtain the anodic oxide film having low heat conductivity and low volume specific heat capacity with the aluminum alloy base material 1, an anodic oxide film 2 can be formed by using an aluminum alloy base material containing different components than the components contained in the aluminum alloy base material 1. The methods for forming the aluminum alloy base material to be used include plating, thermal spraying, deposition, fitting, casting and the like. In this case, in addition to the aluminum alloy base material 1 that is different from the aluminum alloy component used for the anodic oxide film 2, materials of iron, and titanium metal are used as the base material.

The aluminum-based member to which the aforementioned both embodiments are applied can be used as a member constituting a combustion chamber of an internal combustion engine. The combustion chamber of the internal combustion engine is a portion surrounded by a piston 10, a cylinder 11, and a cylinder head 12, for example (see FIG. 8). More specifically, it is a portion surrounded by an upper surface of the piston 10, the cylinder 11, and a bottom surface of the cylinder head 12. Among them, by forming the piston 10 and the cylinder head 12 which are components using the aluminum-based member by using the aluminum-based member of this embodiment, durability and heat insulation of those components can be improved. This type of cylinder 11 can be formed by casting a cylinder sleeve 14 made of cast iron in the cylinder block 13.

Besides, in the case of a sleeveless internal combustion engine not using the cylinder sleeve 14, for example, a bore inner surface of the cylinder block 13 becomes the cylinder 11. Therefore, by using the aluminum-based member in this embodiment for the bore inner surface, durability, heat insulating properties, slidability and the like can be improved. When the aluminum-based member is used for the bore inner surface, plating film or a thermal sprayed film may be formed at the same time.

The other components having a combustion chamber wall surface suitable for application of the present invention include a piston made of an aluminum alloy, a piston made of a magnesium alloy, an iron-based piston, a cylinder made of an aluminum alloy, an iron-based cylinder, a sleeve made of iron, a sleeve made of aluminum, an iron-based valve, a titanium-based valve and the like. By using plating, thermal spraying or deposition, the oxide film 2 can be formed along a surface shape of a component.

Figure 8:
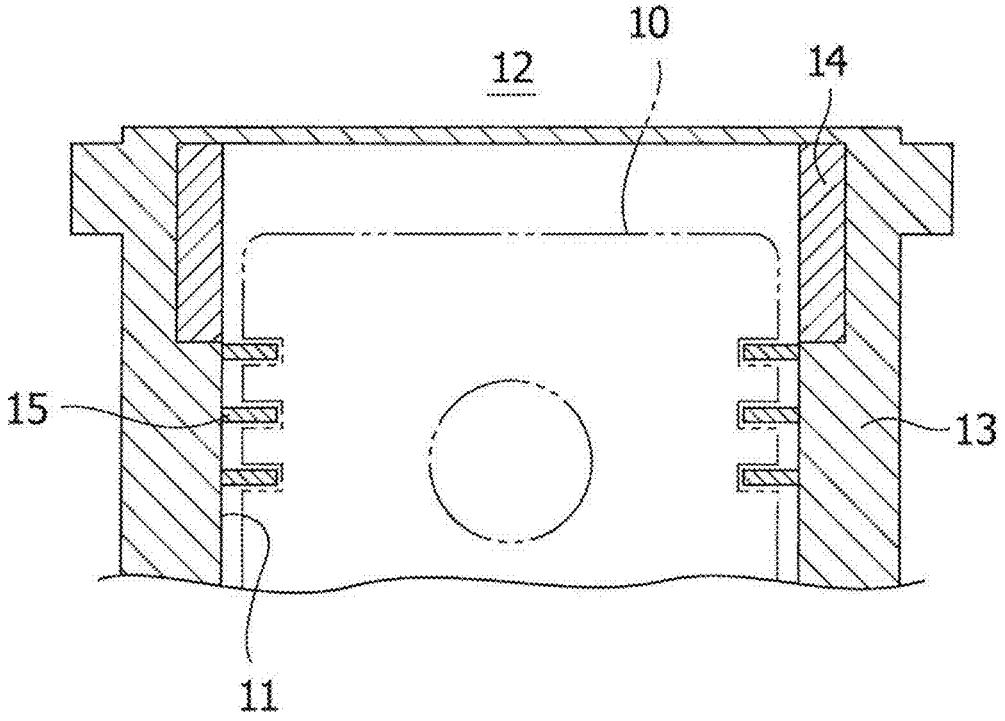
FIG. 8 is a sectional view illustrating an example when the embodiment of the surface structure of the aluminum-based member according to the present invention is applied to a cylinder block of the internal combustion engine.

Moreover, the shape of the aluminum alloy base material 1 is formed having a ring shape when it is to be applied in a cylinder so as to be fitted in the cylinder, while if it is to be applied in an intake/exhaust gas passage other than the combustion chamber, it is only necessary to be cast in a component along the passage shape. FIG. 8 illustrates a section when the ring-shaped aluminum alloy is cast or pressure-fitted in an upper part of combustion.

Moreover, in the case of application of the present invention to an inner side of the combustion chamber of the cylinder block 13, if the method of forming the oxide film 2 by anodizing the cylinder block itself made of an aluminum alloy and if the metal component is different from the cylinder block 13, it may be formed as a component different from the cylinder block 13 so that it is cast or pressure-fit in the cylinder 11.

Furthermore, if the present invention is to be applied to a surface in contact with a combustion gas, it is only necessary that the present invention is applied to the whole surface including a surface in contact with a piston ring 15 of the cylinder block 13 or only to the upper part of combustion not in contact (a surface facing the combustion chamber of the cylinder head, for example). Moreover, it is also possible to thermally spray an aluminum alloy (aluminum-silicon based) to the cylinder block 13 made of an aluminum alloy and then to apply anodic oxidation. As a result, the oxide film 2 specialized in thermal characteristics different from mechanical functions required for the aluminum alloy base material 1 can be formed.

As described above, if a member constituting the internal combustion engine is formed by using the aluminum-based member according to this embodiment, since the aluminum-based member according to this embodiment achieves low heat conductivity and low volume specific heat capacity, heat efficiency of the internal combustion engine can be improved.

Moreover, in the surface structure of the aluminum-based member according to this embodiment, as the pore sealing treatment process, the pore on the surface side of the oxide film 2 may be blocked by applying general pore sealing treatment. As such pore sealing treatment, strong basic sealing bath, boiling water sealing, nickel salt sealing and the like can be cited.

In the embodiment according to the present invention, as the sealing treatment process, the sealing liquid is made to be deposited on the surface of the oxide film of the aluminum-based member, whereby the pores of the oxide film are impregnated with the sealing liquid. The sealing liquid enters the pore in the oxide film and forms a compound in the pore. Particularly the sealing liquid mainly enters the nano-sized pore of the oxide film and forms the compound.

As a result, since the pore is sealed by the sealing product, heat is not conducted easily any more to the inside of the oxide film 2 from the surface of the aluminum-based member, whereby the heat insulating properties/heat shielding properties can be improved. Moreover, even if the corrosive substance adheres to the surface of the aluminum-based member, since the corrosive substance is not easily transferred to the inside of the oxide film 2 through the pore, durability can be improved.

In the sealing treatment process using the strong basic sealing bath, it is preferable that the treatment liquid is coated or sprayed to the aluminum-based member having the oxide film 2 or the aluminum-based member is immersed in the treatment liquid, the member is held in the air and then, washed with water and dried. Moreover, it is preferable that the aluminum-based member having the oxide film 2 is immersed in the treatment liquid and is taken out from the treatment liquid after 0.5 minutes or more and then, washed with water and dried. The sealing treatment method by coating or spraying is capable of partial sealing treatment.

Thus, as in the case of treatment of a large-sized component, a large-sized tank for immersion of the large-sized component is not needed in the treatment.

According to the surface structure of the aluminum-based member according to the present invention, since the void 3*a* is formed inside the silicon composition 3, it is hardly affected by the sealing treatment. In the normal sealing treatment, aluminum oxide present in the oxide film is changed to a hydrate, and the pore is filled by volume expansion of the aluminum oxide. Here, the void 3*a* is present inside the silicon composition 3, and since aluminum oxide is not (scarcely) present around it, the void 3*a* is not filled easily even if the sealing treatment or the like is conducted.

Besides, as a method for blocking the pore in the surface of the oxide film 2, sealing treatment or silica coating may be conducted in addition to the aforementioned method. For example, if sealing treatment is to be conducted by the method as above, the voids formed in the periphery of the silicon composition 3 are blocked, but a gap caused by the crack in the silicon composition 3 is large and its wettability is different and thus, it is not blocked, Thus, the heat insulating properties, heat shielding properties, and corrosion resistance can be given to the oxide film 2 while a low-density film is maintained.

Moreover, in this embodiment, the close oxide film 2 subjected to electrolytic treatment by DC-AC superposition may be further formed on the oxide film 2 fabricated by the aforementioned method or sealing may be carried out by fabricating a silica film such as polysilazane to be subjected to the sealing treatment. As a result, intensity of the oxide film 2 is reinforced, the nano pores and micro pores in the surface are closed, and a smooth film surface can be obtained and thus, adhesion of fuel or fixation of unburned objects are prevented, and interference with the high heat insulating properties/heat shielding properties and a flow of the combustion gas can be made difficult. Moreover, by having many AC-DC superposed layers and DC layers, lowering of intensity can be compensated. By means of the sealing treatment and polysilazane, sealing in the perpendicular direction is carried out with priority, and not by filling the crack in the silicon generated in the horizontal direction which is not desirable for the sealing treatment, a more efficient film can be formed.

In the aforementioned embodiment, the void 3*a* present inside the silicon composition 3 is assumed to extend in the direction substantially orthogonal to the thickness direction of the oxide film 2, but the present invention is not limited to this "substantially orthogonal" but it may naturally extend in a diagonal direction with respect to the direction orthogonal to the thickness direction of the oxide film 2 and in summary, it needs to be understood that the direction in which the void 3*a* extends is a direction different from the thickness direction of the oxide film 2.

An embodiment of the present invention has been described but the present invention is not limited to the aforementioned embodiment but is capable of various variations and changes on the basis of the technical idea of the present invention.

REFERENCE SIGNS LIST

1 aluminum alloy base material (aluminum-based member)
2 anodic oxide film
2*a* pore
2*b* void
3 silicon composition
3*a* void
10 piston
11 cylinder
12 cylinder head
13 cylinder block
14 cylinder sleeve
15 piston ring

Having thus described certain embodiments of the present invention, it is to be understood that the invention defined by the appended claims is not to be limited by particular details set forth in the above description as many apparent variations thereof are possible without departing from the spirit or scope thereof as hereinafter claimed.

The invention claimed is:

1. A surface structure of an aluminum-based member containing at least insoluble silicon particles, wherein a porous oxide film is provided on a surface of the aluminum-based member, and the oxide film has at least a pore extending from the surface toward an inside in a thickness direction of the oxide film, a void originated from and present inside the insoluble silicon particles extending in a direction substantially orthogonal to the thickness direction of the oxide film, and a pore in a periphery of the insoluble silicon particles: and wherein a length of the insoluble silicon particles contained in the aluminum-based member in the thickness direction of the oxide film is 1 μm to 40 μm, and wherein the aluminum-based member contains 8 wt % or more of Si and 2.9 wt % or more of the total of Cu, Ni, Mg, Mn, Zn and Fe, wherein the remaining part consists of aluminum and inevitable impurities.

2. The surface structure of an aluminum-based member according to claim 1, wherein an average length of the void in a thickness direction of the oxide film is larger than an average diameter of the pore.

3. The surface structure of an aluminum-based member according to claim 1, wherein the aluminum-hased member contains 8 wt % or more and 30 wt % or less of the insoluble silicon particles.

4. The surface structure of an aluminum-based member according to claim 1, wherein the aluminum-based member contains a composition eluted to a treatment liquid when the oxide film is generated.

5. The surface structure of an aluminum-based member according to claim 1, wherein density of the oxide film is $0.6\times10^3$ kg/m$^3$ or more and $1.1\times10^3$ kg/m$^3$ or less.

6. The surface structure of an aluminum-based member according to claim 1, wherein density of the oxide film is $0.9\times10^3$ kg/m$^3$ or less.

7. The surface structure of an aluminum-based member according to claim 1, wherein, characterized in that porosity of the oxide film is 70% or more and 90% or less.

8. The surface structure of an aluminum-based member according to claim 1, wherein heat conductivity of the oxide film is 0.65 W/m·K or less.

9. The surface structure of an aluminum-based member according to claim 1, wherein the pores are sealed by a sealing product.

10. The surface structure of an aluminum-based member according to claim 1, wherein a member constituting an internal combustion engine is formed by the aluminum-based member.

11. The surface structure of an aluminum-based member according to claim 1, wherein the oxide film is formed by carrying out DC electrolysis under a current density of 4.8 $A/dm^2$ or less.

* * * * *